US005996781A

United States Patent [19]

Glaser et al.

[11] Patent Number: 5,996,781

[45] Date of Patent: Dec. 7, 1999

[54] CONTAINER HAVING COMPARTMENT FOR HOLDING NOVELTY ARTICLE

[76] Inventors: Robert F. Glaser, 1727 Fern Way, Cleveland, Ohio 44120; Clifford T. Rosenberg, 77 Robinson Road, Hong Kong, China

[21] Appl. No.: 08/920,254

[22] Filed: Aug. 28, 1997

[51] Int. Cl.[6] ..... B65D 1/24

[52] U.S. Cl. ..... 206/217; 215/6

[58] Field of Search ..... 206/217, 216; 215/6, 10; 220/359.1, 504

[56] References Cited

U.S. PATENT DOCUMENTS

| | | | |
|---|---|---|---|
| 544,219 | 8/1895 | Godet | 215/6 |
| 1,289,218 | 12/1918 | Maiden | 215/6 |
| 1,728,883 | 9/1929 | Simon | 215/6 |
| 2,187,558 | 1/1940 | Kushima | 215/6 |
| 3,590,989 | 7/1971 | Wittwer | 215/6 |
| 5,040,719 | 8/1991 | Ballway | 215/6 |
| 5,228,678 | 7/1993 | Matsuda et al. | 220/359.1 |
| 5,419,436 | 5/1995 | Powell | 220/504 |
| 5,487,486 | 1/1996 | Meneo | 215/6 |
| 5,769,680 | 6/1998 | Hoffman | 215/6 |

*Primary Examiner*—Jim Foster

*Attorney, Agent, or Firm*—Kennedy, Davis & Hodge, LLP

[57] ABSTRACT

A container for holding at least one first article in a space defined by walls of the container while permitting selective access to at least one second article in a separate compartment therein. The container body is defined by a side wall extending between a lower edge and an upper distal edge that defines an open end of the body for receiving at least one first article therethrough for being held in a space within the body. A dome-shaped interior wall extends across the space from an interior surface of the side wall to define a closed bottom. The side wall and the interior wall define the space for holding the first article. The interior wall also defines a separate compartment for receiving a novelty article through an opening defined in the body. A selectively-attached detachable cover closes the opening to hold the novelty article within the separate compartment. The novelty article, being placed in the separate compartment, is selectively removed by detaching the cover from over the opening, while the space functions for holding the first article.

10 Claims, 4 Drawing Sheets

CONTAINER HAVING COMPARTMENT FOR HOLDING NOVELTY ARTICLE

TECHNICAL FIELD

The present invention relates to containers for holding fluid or solid matter. More particularly, the present invention relates to containers which function for holding fluid or solid matter (referred to herein as "goods") while also enclosing a novelty article in a separate selectively accessed compartment.

BACKGROUND OF THE INVENTION

It has been found that sales of goods, such as drinks, foods, convenience articles, and other goods sold to consumers, may be increased, promoted or facilitated, by including with the goods a premium separate from the goods being purchased. The premium induces the sale of the goods by offering to the consumer a perceived additional value at little or no additional cost to the consumer over the ordinary cost of the article. The additional value may take the form of a rebate, credit, discount, or second article. For example, toiletries and perfumes frequently are sold in combination with premium articles such as a separate container having a sample of related goods, a carrying case, or other similar articles.

The use of premiums is a marketing technique often used in combination with advertising and promotional campaigns in support of major motion pictures. Often there are "tie-ins" of goods or services offered by other companies. The companies involved pay licensing fees for the right to advertise, market, and sell "tie-in" products and services. The use of premiums as "tie-ins" for sales of goods is typically used in the "fast food" industry for inducing sales of foods. Fast food stores typically offer a children's meal together with a premium as an inducement to the parents through their children to purchase foods at the store for the child, and preferably, for the parent also, thereby increasing the overall sales of the store. The premium typically is enclosed in a separate container and placed with the food products in a bag for delivery to the consumer.

Often the premium is a novelty item associated with the advertising and marketing program of another, such as a major motion picture. The novelty article takes the form of a figurine, toy, or article related to or involved with the motion picture or similar promotion for consumers. In addition, the containers used for the fast food also typically include features in support of the marketing and promotional program. These features include story and illustrations related to the particular subject of the promotional program. For example, many such advertising and marketing programs provide special drink cups and bags with illustrations which tie-in or are associated with the promotional program.

Heretofore, these packaging containers, while tied into the promotional program, have been separate from the premium which is placed in the carry-out bag. While these containers have functioned to enclose purchased products separately from the novelty promotional article, there remains a need in the art for a container for holding the purchased product while also functioning to enclose for selective removal an associated novelty article. It is to such that the present invention is directed.

SUMMARY OF THE INVENTION

The present invention meets the needs of the art by providing a container for holding at least one first article in a space defined by walls of the container while permitting selective access to at least one second article in a separate compartment therein. The container has a body defined by a first wall extending between a lower edge and an upper distal edge that defines an open end of the body for receiving at least one first article therethrough for being held in a space within the body. An interior wall extends across the space from an interior surface of the first wall to define a closed bottom. The first wall and the interior wall define the space for holding the first article. The interior wall also defines a separate compartment for receiving at least one second article through an opening defined by the lower edge of the first wall. A selectively-attached detachable cover closes the opening to hold the second article within the separate compartment. The second article, being placed in the separate compartment, is selectively removed by detaching the cover from over the opening, while the space functions for holding the first article.

In another aspect, the present invention provides a cup for holding a fluid for drinking while enclosing a novelty article in a separate, selectively accessible compartment. The cup has a frustroconical body defined by a side wall. An open end receives therethrough a fluid for being contained within the body. A dome-shaped bottom wall in a lower portion of the body cooperates with the side wall to define a first cavity in the body for receiving and containing the fluid and to define a second cavity in the body which is open at the lower edge of the side wall for selective access into the second cavity. A cover closes the opening. A novelty article, being placed in the second cavity which is closed by the cover, is selectively accessed while the body functions for containing the fluid in the first cavity.

In a preferred embodiment, the cover comprises a flexible sheet having an adhesive layer for securing the cover over the opening. In another preferred embodiment, a ring engaged to a bottom edge of the body receives a coverplate for closing the opening. In this embodiment, a plurality of pins extend longitudinally from the opening and the ring defines a plurality of openings which align with and receive the pins therethrough. The pins define rivets for securing the ring to the bottom wall. The ring also defines at least one narrowed portion therein to define a recess and the ring has at least one upstanding wall that defines a gap between the ring and the body. The coverplate defines at least one ear extending therefrom. The ear is received in the recess, and the coverplate being rotated, the ear is moved into the gap to secure the coverplate to the ring, for selectively closing the opening to the second cavity. A detent secures the coverplate in a closed position.

In another aspect, the present invention provides a container for holding at least one first article in a space defined by walls of the container while permitting selective access to at least one second article in a separate compartment. The container body is formed from a blank of sheet material which defines a back wall, a bottom wall, a front wall, and a pair of sides walls. The walls foldably join together by scores in the blank. The walls define a cavity in the body for receiving a first article. A separate-compartment-defining flap extends from an edge of one of the side walls. The flap defines a pair of opposing side panels and a cross panel foldably joined between the side panels. One of the side panels defines an engagement flap for connecting the one side panel to an interior surface of the back wall of the body. A top panel foldably extends from a score at an edge of the cross panel and has a second engagement flap at a distal edge thereof for connecting the top panel to the interior surface of the back wall. The panels thereby define an open-ended separate compartment within the body for receiving a novelty article therein, through an opening in the body, such as an opening in the bottom wall that is in alignment with the open end of the separate compartment. A selectively-attached, detachable cover closes the opening to hold the novelty article within the separate compartment. The novelty article, being placed in the separate compartment, is selectively removed by detaching the cover, while the cavity functions for holding the first article.

Objects, advantages and features of the present invention will become apparent from a reading of the following detailed description of the invention and claims in view of the appended drawings.

DETAILED DESCRIPTION OF THE PREFERRED EMBODIMENT

Figure 1:
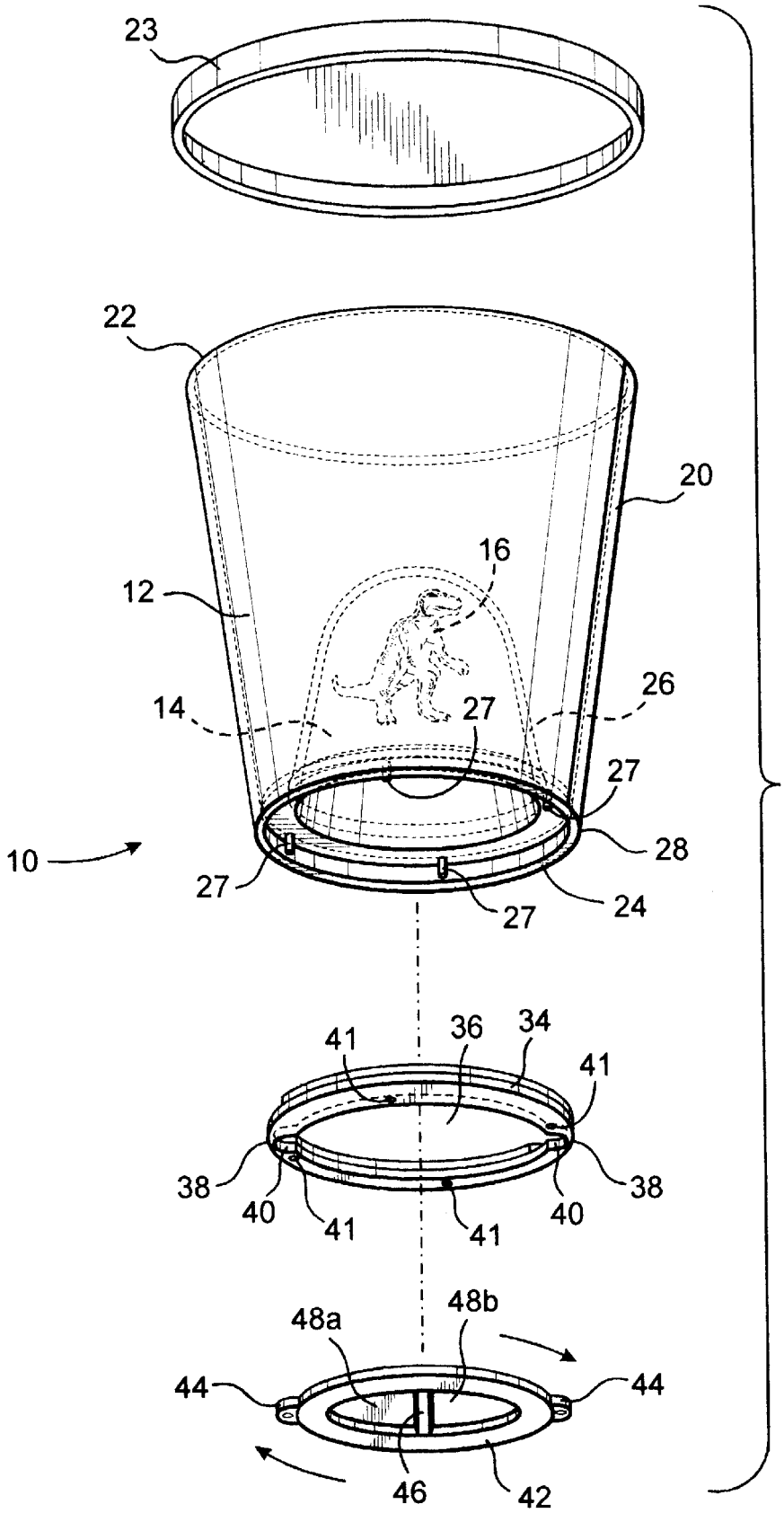
FIG. 1 is a perspective exploded view of a container according to the present invention.

Referring now in more detail to the drawings, in which like numerals indicate like parts throughout the several views, FIG. 1 illustrates in perspective exploded view a cup 10 constructed in accordance with the present invention for a container which functions for holding goods, such as fluids or discrete articles, in a cavity 12 while also providing a selectively accessed compartment 14 for enclosing a novelty article or premium 16 such as the toy dinosaur illustrated in phantom. A preferred embodiment of the container 10 defines a drinking cup. The cup 10 is defined by a continuous side wall 20, which in the illustrated embodiment the cup 10 defines an inverted frustroconical body having an upper open end 22 and a lower open end 24. A cap 23 is selectively placed on the open end 29 to close the cup 10. An interior wall 26 forms a closed bottom for the cup 10. The interior wall 26 in the illustrated embodiment defines a dome in which the apex is disposed in a central portion of the cavity 12 and the lower edge is integral with the side wall 20 at a lower portion 28 of the cup 10. The sidewall 20 and the interior wall 26 accordingly define the open ended cavity 12 within the cup 10 for receiving goods. A plurality of pins 27 extend outwardly through the open end 24 from a lower surface of the interior wall 26 near the side wall 20, for a purpose discussed below.

The interior wall 26 also defines the cavity 14 in the lower portion 28 of the cup 10 which is accessed through the lower end 24 of the cup. A ring 34 is received by the lower end 24, as discussed in detail below. The ring 34 defines an opening 36. In the illustrated embodiment, the ring 34 has two oppositely-disposed narrowed portions 38 which define U-shaped portions or recesses 40 of the opening 36 in opposing sides of the ring 34. Four openings 41 are defined in the ring 34, which openings align with the pins 27 for positioning the ring on the cup 10.

The ring 34 receives a cover plate 42 for closing the cavity 29. A pair of ears 44 extend outwardly from the cover plate 42 on opposing sides. The ears 44 are sized for being received through the recesses 40 for engaging the coverplate 42 to the ring 34, as discussed below. The coverplate 42 has a cross-member 46 which in the illustrated embodiment is disposed substantially transverse to a line defined by the pair of ears 44. The cross-member 46 divides the coverplate 42 into two recessed spaces 48*a,* 48*b* for receiving fingers, whereby the cover plate 42 may be rotated relative to the ring 34, as discussed below. In an alternate embodiment, the narrowed portions 38 are not oppositely disposed, so as to define a key so that the cover fits it a selected orientation only.

Figure 2:
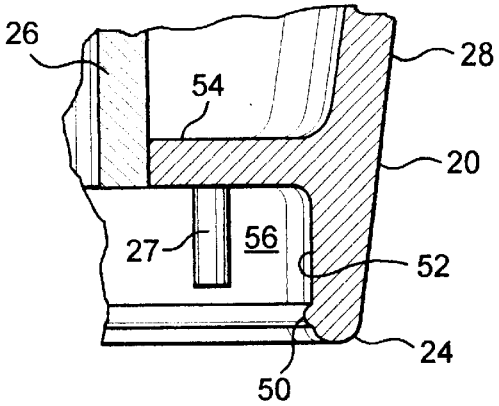
FIG. 2 is a detailed cross-sectional view of a lower portion of the container illustrated in FIG. 1 to show features of the container.

FIG. 2 is an enlarged detailed view of the lower portion of the cup 10 shown in FIG. 1. A flange 50 extends laterally inwardly from an interior surface 52 of the sidewall 20 near the lower end 24. The interior wall 26 is integrally engaged to the sidewall 20 by a substantially transverse portion 54 of the interior wall 26. The transverse portion 54 and the lower portion of the sidewall 20 cooperatively define a channel 56 in the lower portion of the cup 10 for receiving the ring 34. The pins 27 extend from a lower surfaces of the transverse portion for mating engagement of the ring 34 to the bottom of the cup, as discussed below. Accordingly, the transverse portion 54 can be viewed as a bottom wall defining an opening into the cavity 14 and integrally connected to an interior dome-shaped wall, which together defines the cavity 14.

Figure 3:
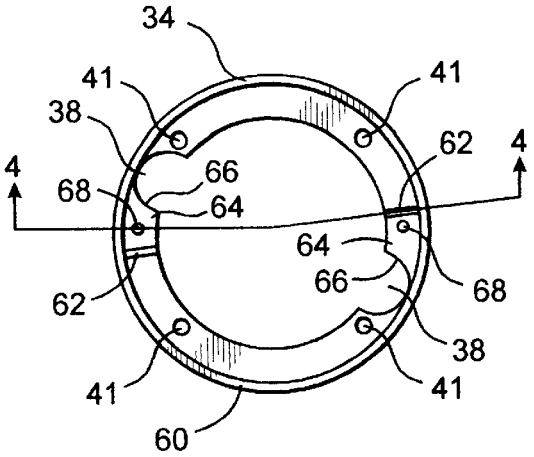
FIG. 3 is a top plan view of a ring received in a lower end of the container illustrated in FIG. 1.
Figure 4:
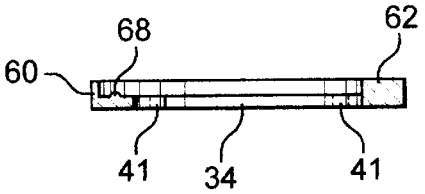
FIG. 4 is a cross-sectional view of the ring illustrated in FIG. 3, taken along line 4—4.

FIG. 3 is a top plan view of the ring 34 and FIG. 4 is a cross-sectional view of the ring 34 taken along lines 4—4. A skirt 60 extends upwardly around a perimeter edge of the ring 34. A pair of walls 62 extend laterally inwardly from the skirt 60 on opposing sides of the ring 34. The walls 62 are spaced from the narrow portion 38 and define a shelf 64 in the ring 34 between the wall 62 and an edge 66 of the narrow portion 38 of the ring 34. A lug 68 extends upwardly from the shelf 64. The four openings 41 are defined in the ring 36. In the illustrated embodiment, the openings 41 are equally spaced around the perimeter of the ring 34, for alignment with the pins 27 as discussed below.

Figure 5:
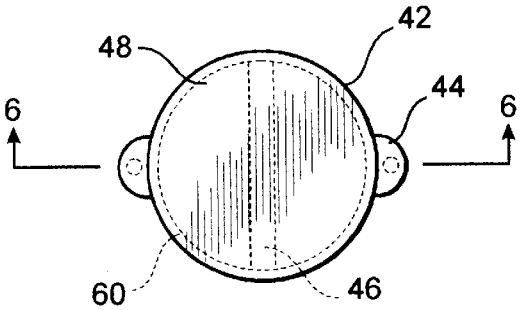
FIG. 5 is a top plan view of a cover plate received by the ring illustrated in FIG. 3 for closing the container illustrated in FIG. 1.
Figure 7:
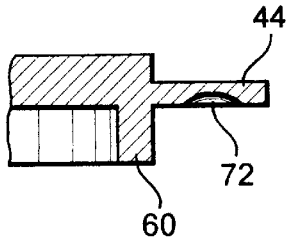
FIG. 7 is a detailed cross-sectional view of an ear of the cover plate illustrated in FIG. 5, taken along line 7—7.
Figure 6:
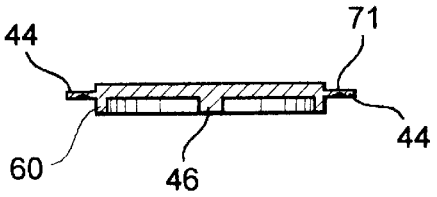
FIG. 6 is a cross-sectional view of the cover plate illustrated in FIG. 5, taken along line 6—6.

FIG. 5 is a bottom plan view of the coverplate 42 and is FIG. 6 is a cross-sectional side view taken along 6—6 of FIG. 5. The ears 44 extend laterally on opposing sides of the coverplate 42. The ears 44 are preferably off-set generally 71 relative to an upper surface 70 of the coverplate 42. As best illustrated in FIG. 7, the lower surface of the ears 44 each define a dish-shaped recess 72. The cross-member 46 divides the coverplate into the two recessed sections 48*a* and 48*b*.

Figure 8:
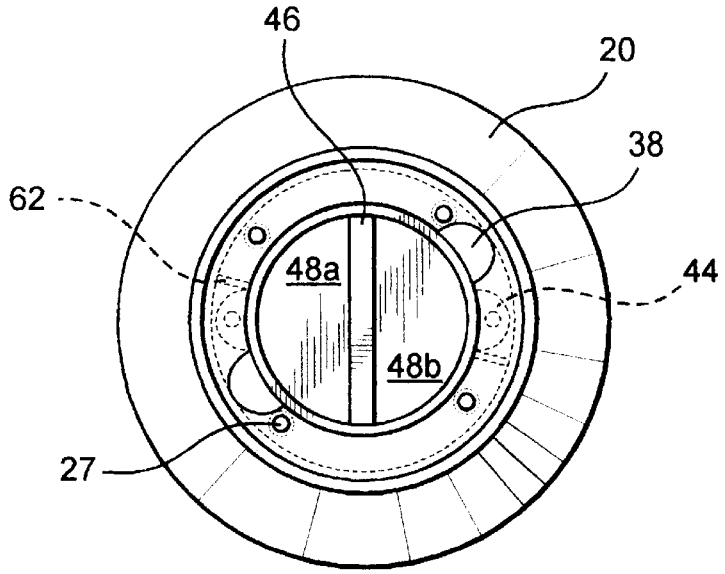
FIG. 8 is a bottom view of the container illustrated in FIG. 1.

The operation of the cup 10 is understood with reference to FIGS. 1 and 8. FIG. 8 is a bottom view of the top 10 illustrated in FIG. 1. The ring 34 is matingly received in the channel 56 by aligning the openings 41 with the pins 27. In the illustrated embodiment, the perimeter edge of the ring 34 closely aligns with the interior surface 52 of the sidewall 20 near the lower end. The ring 34 preferably snaps into place in the channel 56 and is held therein by the flange 50 which extends around the interior perimeter of the sidewall 30. The pins 27 extend through the openings 41. The distal ends of the pins 27 are briefly heated and melted to define rivets securing the ring 34 to the bottom of the cup 10. An alternate embodiment however does not include the pins 27. Rather, the location of the pins in the illustrated embodiment define openings which align with the openings 41 in the ring. A screw or plastic plug extends through the openings 41 and into the aligned openings in the bottom of the cup 10 in order to engage the ring 34 to the cup 10.

Upper edges of the perimeter skirt 60 and the walls 62 contact the lower surface of the transverse portion 54 of the inner wall 26. A space is thereby defined between the transverse portion 54 and the shelf 64 in the ring 34.

One of the novelty articles 16, such as the toy dinosaur illustrated in FIG. 1, is then inserted through the open end 24 into the cavity 14. The coverplate 42 is thereafter positioned on the ring 34. The ears 44 are positioned in the recesses 40 which define key spaces for receipt of the ears.

With reference to FIGS. 3 and 8, the coverplate 42 is gripped with fingers in the recesses 48*a,* 48*b.* A twisting pressure is applied to the cross-member 46 in order to rotate the coverplate 42 relative the ring 34. The ears 44 pass over the edge 66 of the shelf 64. The ears 44 travel in the space defined between the transverse portion 54 and the shelf portion 64. The recesses 72 engage the respective lugs 68 in the shelf 64, as shown in broken line in FIG. 8, to secure the coverplate 42 to the ring 34 and thereby close the cavity 14. Other detent/engagement mechanisms are gainfully employed, such as a friction fit sloping surface. The cup 10 thereafter may be used as a container for holding goods, such as a liquid. The novelty article 16 is contained within the dome-shaped cavity 14.

In a preferred embodiment, the cup 10, the ring 34, and the coverplate 42 are manufactured by molding with a clear K-resin plastic. The novelty article 16 is visible through the sidewall 20. The novelty article 16 is selectively removable from the cup while it continues to function as a container for liquids. This is accomplished by holding the cup 10 in the air, inserting fingers into the recesses 48*a,* 48*b,* and imparting a twisting pressure against the cross-member 46. The lugs 68 detach from the recesses 72 in the ears. The ears 44 enter the recesses 40 and the cap 42 is thereby disengaged from the ring 34. The article 16 is then removed from the cup 10. The cup 10 continues to function as an enclosing article for the liquids contained within the cavity 12. In an alternate embodiment, the open end 22 is selectively closed by the close fitting lid 23 in order to prevent the liquids from slopping over the sides of the cup 10.

Figure 9:
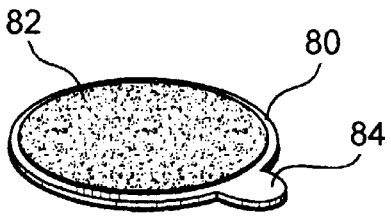
FIG. 9 is a plain view of an alternate embodiment of a cover for closing the novelty-holding cavity in the cup illustrated in FIG. 1.

In another embodiment best illustrated in FIG. 9, the open end 24 is closed by a paper sticker 80 having an adhesive layer 82. The adhesive layer 82 engages the lower surface of the transverse portion 54. In the illustrated embodiment, the adhesive layer 82 defines a shape corresponding to the perimeter of the opening 36 in the ring 34. A tab 84 is grasped in order to remove the sticker 80 from closing the cavity 14 that holds the novelty article 16. In this embodiment, the lower end 24 of the cup 10 does not include the pins 27. Further, the ring 34 and the cap 42 are not used, resulting in a possible reduction in cost while the cup 10 of this embodiment functions to hold liquids within the cavity 12 while providing selective access to the novelty article 16 in the cavity 14.

Figure 10:
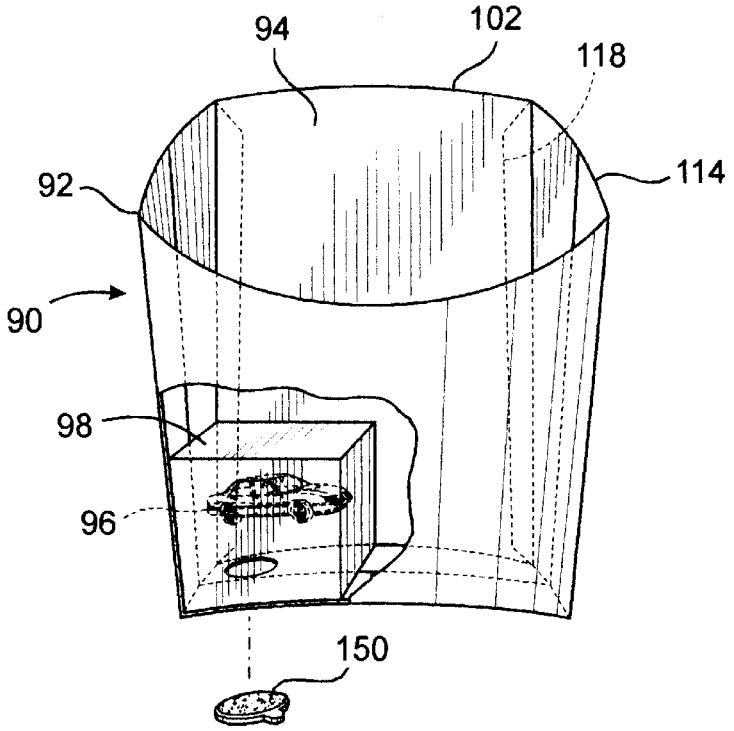
FIG. 10 is a perspective view of an alternate embodiment of a container according to the present invention.

FIG. 10 is a perspective view of alternate embodiment of a container 90 according to the present invention. The container 90 provides a body 92 that defines a cavity 94 for holding articles while also defining a separate, selectively accessed compartment 98 for enclosing a novelty article 96. The container 90 is formed from a blank 100 which folds and attaches together to define a back wall 102, a bottom 104, and a front wall 106. The blank 100 is made of a sheet material, and preferably, is made of a sheet material conventionally known as paperboard.

Figure 11:
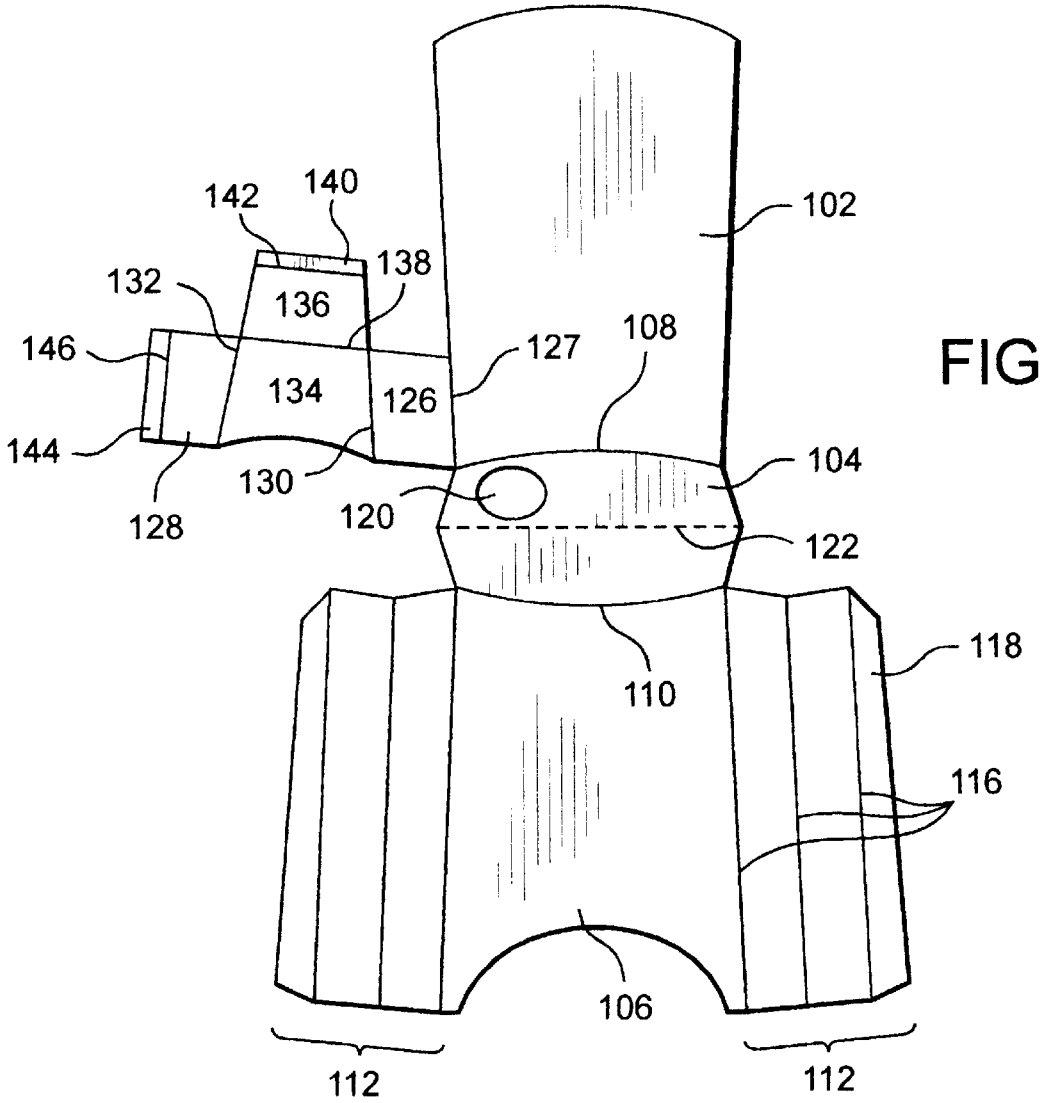
FIG. 11 is a plan view of a blank for forming the container illustrated in FIG. 10.

As illustrated in the plan view of FIG. 11, the blank 100 includes scores 108 and 110 which separate the back wall 102 and the bottom 104 and the bottom 104 and the front wall 106, respectively. The front wall 106 includes lateral portions 112 which define side walls 114 of the container 90. The side walls 114 are defined by three spaced-apart scores 116 which permit the lateral portions 112 to fold in order to define the respective side walls 114 extending between the front wall 106 and the back wall 102. Lateral surfaces 118 of the lateral portion 112 fold over and engage a back surface of the back wall 102 in order to form the body 92 which defines the cavity 94. The bottom 104 defines an opening 120 for receiving there through the novelty article 96. A score 122 extends laterally between side edges of the bottom 104.

A compartment-defining flap 125 extends laterally form an edge of the back panel 102. The flap 125 defines a pair of side panels 126 and 128 foldably divided by scores 130 and 132 form a cross panel 134. A top 136 is foldably engaged to the cross panel 134 by a score 138. A flap 140 is defined in a distal edge portion of the top panel 136 by a score line 142. A laterally distal edge portion is defined by a score 146 in the side panel 128.

The blank 100 is formed into the container 90 by folding the flap 125 on the scores 127, 130, 132, and 146. The side flap 144 is attached to an interior face of the back wall 102. The top panel 136 is folded on the score 138 and the score 142. The distal portion 140 is adhered to the interior surface of the back wall 102, thereby defining the compartment 98 which is open from the bottom.

The body 92 is then formed. The lateral portions 112 of the front wall 106 are folded on the scores 116. The lateral portion 118 is adhered to a back surface of the back wall 102, thereby defining the container 90 having the cavity 94. The novelty article 96 is received within the compartment 98 through the opening 120. A cover 150 is attached with adhesive to the lower surface of the bottom wall in order to close the opening 120.

The container 90 is thereafter used for holding articles within the cavity 94 such as french fries, while also enclosing the novelty article 96 within the separate selectively accessed compartment 98. The novelty article 96 is removed by disengaging the cover 150 from the bottom of the container 90. The container 90 however continues to function for the purpose of holding the goods within the cavity 94. It is to be especially noted that other layouts of the blanks 100 may be gainfully used to provide a container according to the present invention.

The present invention accordingly provides a container for holding goods, particularly such as drinks or food items, together with a premium or novelty article, selectively accessible in a compartment within in the container while the container functions for its primary purpose of holding the goods.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A cup for holding a fluid for drinking while enclosing a novelty article in a separate, selectively accessible compartment therein, comprising:

a frustroconical body defined by a side wall and having an open end for receiving therethrough a fluid for being contained within the body;

a dome-shaped bottom wall in a lower portion of the body cooperating with the side wall to define a first cavity in the body for receiving and containing the fluid and defining a second cavity in the body;

a plurality of spaced-apart pins extending longitudinally from the bottom wall;

the lower edge of the side wall defining an opening for selective access into the second cavity;

a ring engaged to a bottom edge of the body and defining an opening through which the novelty article passes into the second cavity, the ring defining a plurality of openings for aligning with and receiving the pins which define rivets for securing the ring to the bottom wall; and a coverplate received by the ring for closing the opening to the second cavity, whereby a novelty article, being placed in the second cavity which is closed by the coverplate, is selectively accessible while the body functions for containing the fluid in the first cavity.

2. The cup as recited in claim 1, wherein the ring defines at least one narrowed portion therein to define a recess and the ring having at least one upstanding wall that bears against the bottom wall to define a gap therebetween; and wherein the coverplate defines at least one ear extending therefrom, which ear is received in the recess, and the coverplate being rotated, the ear moves into the gap to secure the coverplate to the ring, for selectively closing the opening to the second cavity.

3. The cup as recited in claim 2, further comprising a detent on the ring to secure the coverplate in a closed position.

4. The cup as recited in claim 3, wherein the detent comprises:

a lug extending from the ring partially through the gap; and a lower surface of the ear defining a detent recess which engages the lug upon rotation of the coverplate from a first position with the ear received in recess and a second position with the ear engaged to the lug.

5. A container for holding at least one first article in a space defined by walls of the container while permitting selective access to at least one second article in a separate compartment defined therein, comprising:

a body defined by a first wall extending between a lower edge and an upper distal edge and defining an open end of the body for receiving at least one first article therethrough for being held in a space within the body;

an interior wall extending across the space to define a closed bottom thereof from an interior surface of the first wall, the first wall and the interior wall defining the space for holding the first article, the interior wall defining a separate compartment for receiving at least one second article therein, and an opening thereto defined by a lower edge of the body;

a plurality of spaced-apart pins extending longitudinally from the interior wall;

a ring defining a plurality of openings that align with the pins, whereby the ring is received thereon, which pins define rivets for engaging the ring to the body, the ring defining a second opening for accessing the separate compartment;

a selectively-attached detachable cover for closing the opening in the ring to hold the second article within the separate compartment, whereby the second article, being placed in the separate compartment, is selectively removed therefrom by detaching the cover while the space functions for holding the first article therein.

6. The container as recited in claim 5, wherein the cover comprises a flexible sheet having an adhesive layer for securing the sheet to the bottom wall.

7. The container as recited in claim 6, wherein the adhesive layer is defined by a band of adhesive around a perimeter of the sheet.

8. The container as recited in claim 7, wherein the band is greater in size and in conforming shape to the opening defined in the bottom wall, whereby the cover adheres to a portion of the bottom wall around the opening.

9. The container as recited in claim 5, wherein the ring defines at least one narrowed portion therein and the ring having at least one upstanding wall that bears against the interior wall to define a gap therebetween; and wherein the cover defines at least one ear extending therefrom, which ear is received within the gap and being rotated, secures the cover to the ring.

10. The container as recited in claim 5, further comprising a lid for selectively closing the open end of the body.

* * * * *